US009579881B2

(12) United States Patent
Kusaka

(10) Patent No.: US 9,579,881 B2
(45) Date of Patent: Feb. 28, 2017

(54) ROTARY SCREEN PRINTING PRESS

(71) Applicant: KOMORI CORPORATION, Tokyo (JP)

(72) Inventor: Akehiro Kusaka, Tsukuba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 14/485,297

(22) Filed: Sep. 12, 2014

(65) Prior Publication Data

US 2015/0075396 A1 Mar. 19, 2015

(30) Foreign Application Priority Data

Sep. 13, 2013 (JP) ..... 2013-190087

(51) Int. Cl.

| | |
|---|---|
| ***B41F 15/44*** | (2006.01) |
| ***B41F 15/46*** | (2006.01) |
| ***B41F 15/38*** | (2006.01) |
| *B41F 15/08* | (2006.01) |
| *B41F 15/14* | (2006.01) |

(52) U.S. Cl.

CPC ..... *B41F 15/46* (2013.01); *B41F 15/0809* (2013.01); *B41F 15/38* (2013.01); *B41F 15/44* (2013.01); *B41F 15/08* (2013.01); *B41F 15/14* (2013.01)

(58) Field of Classification Search

None

See application file for complete search history.

(56) References Cited

U.S. PATENT DOCUMENTS

| | | | | |
|---|---|---|---|---|
| 2,730,043 | A * | 1/1956 | Louft | 101/123 |
| 2,928,340 | A * | 3/1960 | Stein et al. | 101/120 |
| 3,557,690 | A | 1/1971 | Voegelin | |
| 3,960,076 | A * | 6/1976 | Wick | 101/119 |
| 4,779,529 | A * | 10/1988 | Ericsson | 101/123 |
| 5,479,854 | A * | 1/1996 | Chikahisa et al. | 101/123 |

(Continued)

FOREIGN PATENT DOCUMENTS

| | | |
|---|---|---|
| EP | 2 835 258 A2 | 11/2015 |
| JP | 7-241977 A | 9/1995 |
| JP | 2008-201119 A | 9/2008 |

OTHER PUBLICATIONS

Extended European Search Report dated Feb. 23, 2015 issued in corresponding European Application No. EP 14 18 4605.5.

(Continued)

*Primary Examiner* — Jill Culler

(74) *Attorney, Agent, or Firm* — Birch, Stewart, Kolasch & Birch, LLP

(57) ABSTRACT

A rotary screen printing press includes: a screen plate; a squeegee; squeegee supporting means for supporting the squeegee; and a worm and a worm wheel. The squeegee supporting means includes: a supporting plate swingably supported and supporting the worm and the worm wheel; an eccentric sleeve configured to adjust the position of the center of swinging movement of the supporting plate; and a contact surface and a screw configured to limit the direction of the movement of the supporting plate. The eccentric sleeve and the contact surface and screw cooperate with each other to move the tip of the squeegee along the tangent line of an impression cylinder at a position at which the screen plate and the squeegee contact each other.

3 Claims, 6 Drawing Sheets

(56) References Cited

U.S. PATENT DOCUMENTS

| | | | | |
|---|---|---|---|---|
| 6,062,135 | A * | 5/2000 | Buechele et al. | 101/129 |
| 8,714,083 | B2 * | 5/2014 | Numauchi et al. | 101/120 |
| 2014/0047991 | A1 * | 2/2014 | Kusaka | 101/123 |

OTHER PUBLICATIONS

Observations by a Third Party for EP Application No. 14184605.5 dated Oct. 5, 2015.

* cited by examiner

ROTARY SCREEN PRINTING PRESS

TECHNICAL FIELD

The present invention relates to a rotary screen printing press which performs screen printing by using a cylindrical screen plate.

BACKGROUND ART

Rotary screen printing presses utilizing a rotary screen unit have heretofore been known as high-speed printing apparatuses for printing objects made from a wide range of materials such as cloth and paper. The rotary screen printing presses employ a printing method involving pushing ink with a squeegee through through-holes formed in the plate surface of a screen plate formed in a cylindrical shape to transfer the forced ink onto a printing object.

In general, in such a rotary screen printing press, the squeegee includes a squeegee body (blade) configured to push ink, and a support (squeegee bar) supporting the blade. To mount the squeegee on the rotary screen printing press, the squeegee is positioned inside a rotary screen, and opposite end portions of the squeegee bar are fixed to squeegee supporting means. Note that the rotary screen refers to a screen plate formed in a cylindrical shape and having end rings attached to the opposite ends thereof as supporting members.

There has been known a structure in which a conventional rotary screen printing press as described above includes screen-plate supporting means for supporting a rotary screen in such a way that the rotary screen can be engaged with and disengaged from an impression cylinder, and squeegee supporting means for supporting the opposite ends of a squeegee bar in such a way that a blade can be engaged with and disengaged from the inner peripheral surface of the rotary screen (see Patent Literature 1, for example).

Moreover, there has been known a technique for a screen printing press using a flat screen plate to perform screen printing, in which the angle of the squeegee is adjusted based on printing conditions such as the viscosity of the ink, the diameter of the print pattern holes, and the pitch of the holes (see Patent Literature 2, for example).

CITATION LIST

Patent Literatures

{Patent Literature 1} Japanese Patent Application Publication No. 2008-201119

{Patent Literature 2} Japanese Patent Application Publication No. Hei 7-241977

SUMMARY OF INVENTION

Technical Problem

Like Patent Literature 2 mentioned above, rotary screen printing presses are also required to adjust the angles of their squeegees. However, in a rotary screen printing press, a printing object comes into contact with the peripheral surface of the rotary screen, or a cylindrical body. Thus, a problem may occur in that the adjustment of the squeegee angle displaces the tip of the squeegee from the contact position and deteriorates the print quality.

In view of the above, an object of the present invention is to provide a rotary screen printing press capable of squeegee angle adjustment and capable of high quality printing.

Solution to Problem

A rotary screen printing press according to the present invention for solving the above-mentioned problem includes: a screen plate formed in a cylindrical shape; a squeegee; squeegee supporting means for supporting the squeegee; and an angle adjustment unit configured to adjust an angle of the squeegee, in which the squeegee supporting means includes an arm swingably supported and supporting the angle adjustment unit, a squeegee position adjustment unit configured to adjust a position of a center of swinging movement of the arm, and a stopper part configured to limit a direction of the movement of the arm, and the squeegee position adjustment unit and the stopper part cooperate with each other to move a tip of the squeegee along a tangent line of an impression cylinder at a position at which the screen plate and the squeegee contact each other.

Moreover, the stopper part includes a contact surface formed as a flat surface, and a contact member configured to contact the contact surface, and the center of the swinging movement of the arm and the contact surface are arranged on the tangent line of the impression cylinder at the position at which the screen plate and the squeegee contact each other.

Advantageous Effect of Invention

According to the rotary screen printing press according to the present invention, it is possible to adjust the angle of the squeegee in accordance with printing conditions while maintaining the print quality. Thus, high quality printing can be performed constantly.

DESCRIPTION OF EMBODIMENT

Hereinbelow, a rotary screen printing press according to an embodiment of the present invention will be described in detail with reference to the drawings. Here, it is needless to say that the rotary screen printing press according to this embodiment is not limited to the structure to be described below, and various changes can be made without departing from the gist of the present invention.

Figure 1:
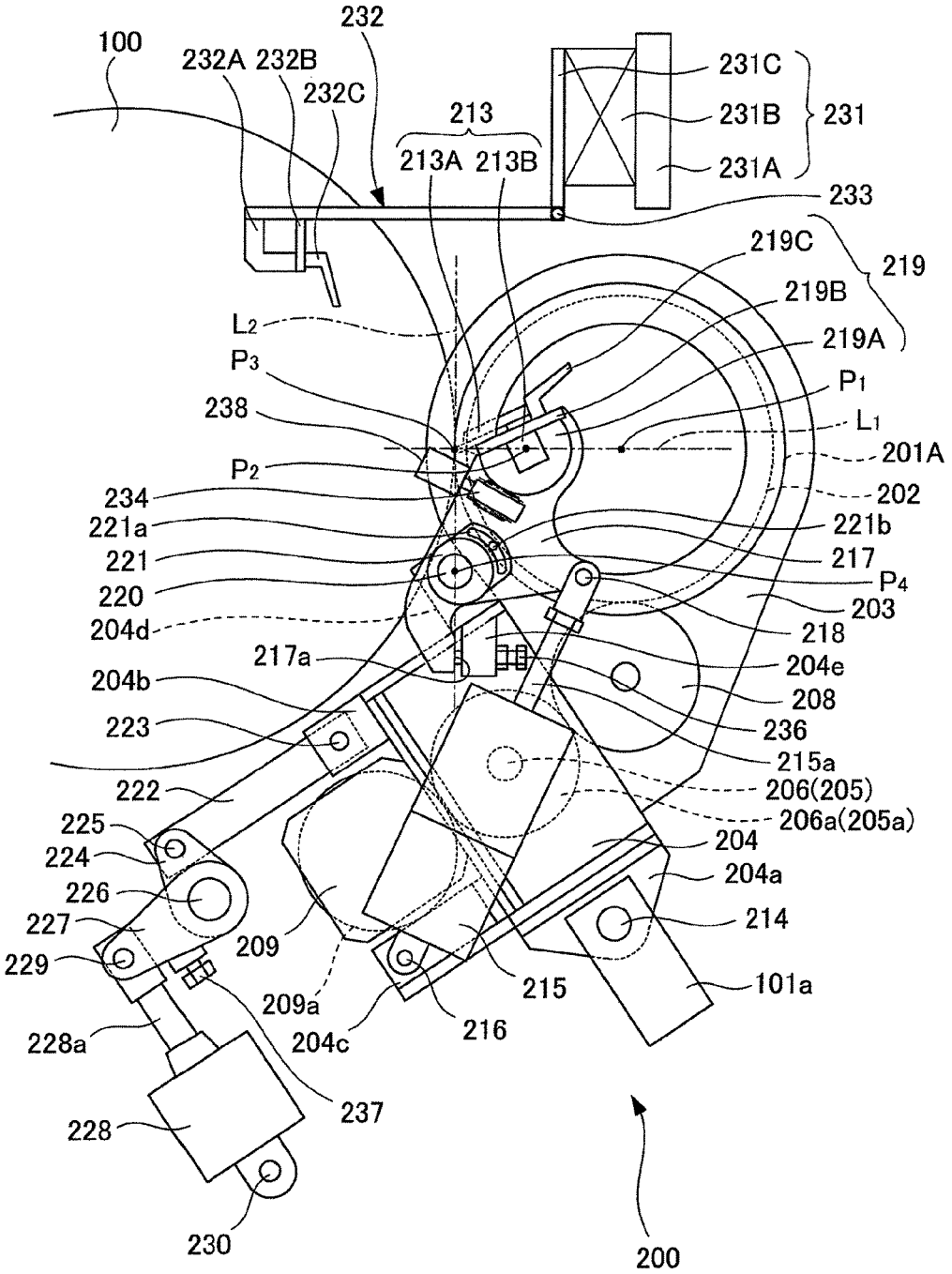
FIG. 1 is an explanatory view showing a rotary screen printing press according to an embodiment of the present invention.
Figure 2:
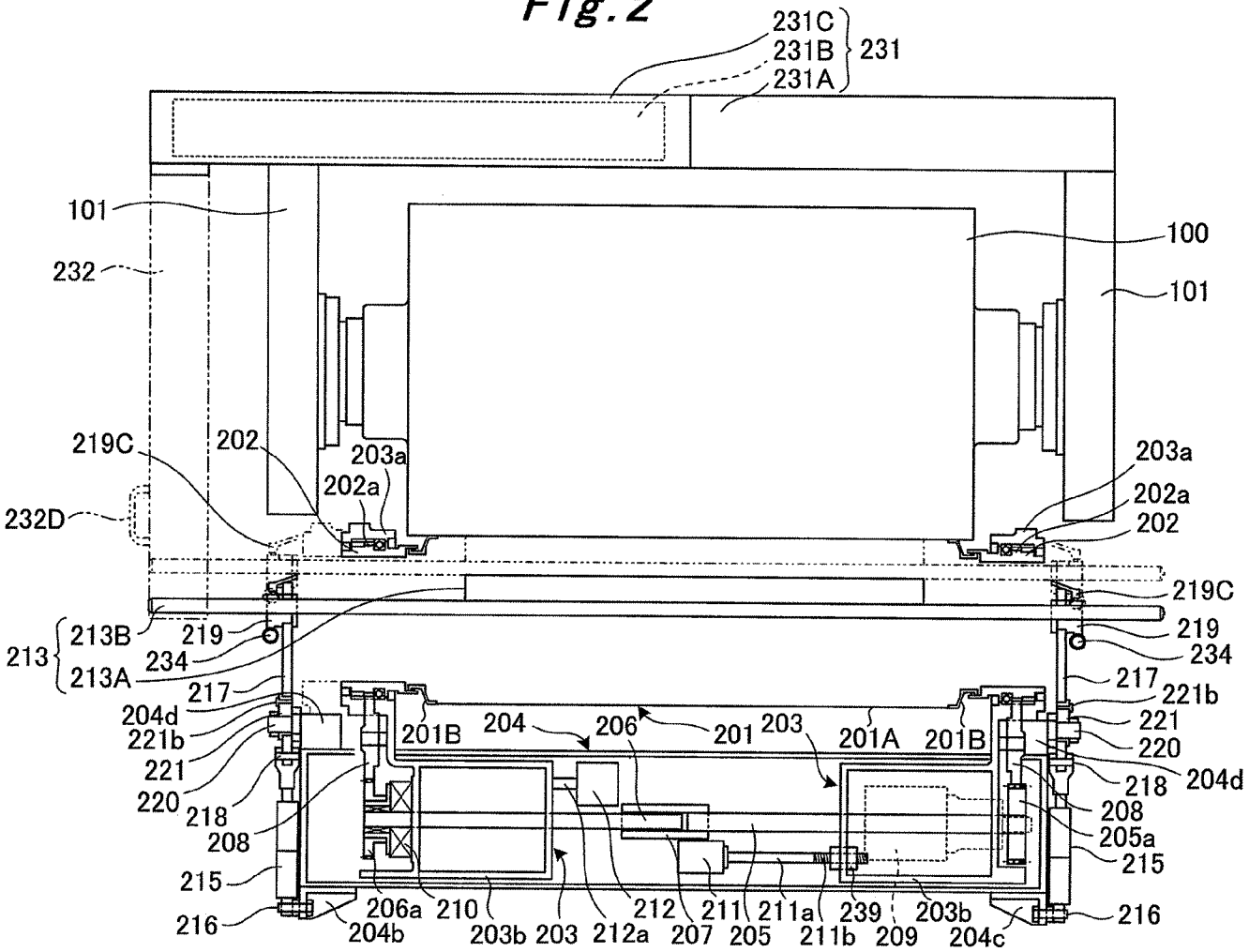
FIG. 2 is a developed plan view of FIG. 1.

As shown in FIGS. 1 and 2, the rotary screen printing press according to this embodiment includes an impression cylinder 100 and a rotary screen unit 200.

The impression cylinder 100 is rotatably supported between left and right machine frames 101, 101. Though not illustrated, a notched portion is formed in the outer peripheral surface of the impression cylinder 100 along the axial direction of the impression cylinder 100. There are multiple notched portions (e.g. two in this embodiment) formed at an equal interval in the circumferential direction of the impression cylinder 100. Moreover, inside these notched portions, the impression cylinder 100 includes gripper units (holding portions) not shown configured to grip and hold a tip of a sheet which is a printing object.

On the other hand, the rotary screen unit 200 includes a rotary screen 201 and a squeegee 213.

<Rotary Screen>

As shown in FIG. 2, the rotary screen 201 includes a screen plate 201A and annular end rings 201B, 201B fixed to opposite ends (left and right ends in FIG. 2) of the screen plate 201A, respectively. The screen plate 201A is a cylindrical body being a cylindrical thin plate material through which fine holes are etched in a given pattern. Each end ring 201B is a member for reinforcing the screen plate 201A.

Here, a protruding portion not shown (hereinafter, "end-ring protruding portion"), multiple (two in this embodiment) notched portions not shown (hereinafter, "end-ring notched portions), and a pin groove not shown are formed on and in each end ring 201B. The end-ring protruding portion is a flange protruding radially outward from the outer peripheral surface of an end portion on the opposite side from the screen plate 201A in the axial direction of the end ring 201B. The multiple end-ring notched portions are provided in this end-ring protruding portion at an equal interval in the circumferential direction. The pin groove is provided in the end-ring protruding portion between the adjacent end-ring notched portions and formed by cutting the outer peripheral surface of the end-ring protruding portion in a U-shape toward the axis. These end rings 201B are supported on bearing members 202.

Meanwhile, multiple (two in this embodiment) protruding portions not shown (hereinafter, "bearing-member protruding portions") are formed on each bearing member 202, and a pin not shown is provided thereon as well. The bearing-member protruding portions protrude radially inward from the inner peripheral surface of the bearing member 202 on the end ring 201B side in the axial direction thereof and provided at an equal interval in the circumferential direction (the same interval as that of the end-ring notched portions). Note that the shape of the bearing-member protruding portions is designed such that the bearing-member protruding portions can pass through the end-ring notched portions in the radial direction. Moreover, the pin is fixed to one of the bearing-member protruding portions in such a way as to be engaged with the pin groove in the end ring 201B when the end ring 201B is attached to the bearing member 202.

To attach each end ring 201B to the corresponding bearing member 202, the rotary screen 201 is moved in the axial direction with the end-ring notched portions of the end ring 201B and the bearing-member protruding portions of the bearing member 202 aligned with each other in the circumferential direction, to thereby insert the end ring 201B into the hollow portion of the bearing member 202 to such an extent that the bearing-member protruding portions and the pin are positioned inside the end-ring protruding portion in the axial direction. Thereafter, the rotary screen 201 is turned relative to the bearing member 202 to align the pin groove of the end ring 201B and the pin of the bearing member 202 with each other in the circumferential direction. Then, the rotary screen 201 is moved in the axial direction relative to the bearing member 202 to bring the pin of the bearing member 202 into engagement with the pin groove of the end ring 201B. As a result, the end-ring protruding portion and the bearing-member protruding portions overlap each other in the circumferential direction. Accordingly, the rotary screen 201 can be prevented from falling from the bearing member 202. In addition, by the engagement between the pin groove of the end ring 201B and the pin of the bearing member 202, the rotary screen 201 can be supported on the bearing member 202 with circumferential movement of the rotary screen 201 relative to the bearing member 202 restricted in a state where the phase of the rotary screen 201 accurately coincides with that of the bearing member 202 (in register in the top-bottom direction).

Moreover, to detach each end ring 201B from the corresponding bearing member 202, the rotary screen 201 is moved outward in the axial direction (toward the bearing member 202) to release the engagement between the pin groove of the end ring 201B and the pin of the bearing member 202, and position the bearing-member protruding portions and the pin of the bearing member 202 inside the end-ring protruding portion in the axial direction. Then, since the end-ring protruding portion and the bearing-member protruding portions overlap each other in the circumferential direction, the rotary screen 201 is turned relative to the bearing member 202, and the rotary screen 201 is moved in the axial direction with the end-ring notched portions and the bearing-member protruding portions aligned with each other in the circumferential direction. As a result, the end ring 201B (rotary screen 201) is removed from the bearing member 202.

The rotary screen 201 according to this embodiment having the above-described structure includes rotary-screen rotationally driving means, rotary-screen left-right registration adjusting means, and rotary-screen engaging-disengaging means.

<Rotary-Screen Rotationally Driving Means and Rotary-Screen Left-Right Registration Adjusting Means>

Hereinbelow, the rotary-screen rotationally driving means and the rotary-screen left-right registration adjusting means in this embodiment will be described with reference to FIGS. 1 to 3.

In this embodiment, the rotary-screen rotationally driving means for rotationally driving the rotary screen 201 at the opposite ends thereof includes a drive motor 209, gears 209*a*, 205*a*, 206*a*, 208, 202*a*, rotary shafts 205, 206, a coupling member 207, and a clutch 210, all of which are shown in FIGS. 1 and 2. Moreover, the rotary-screen left-right registration adjusting means includes two rotary-screen brackets 203, the rotary shafts 205, 206, a rotary-screen position adjustment motor 211, and a tension cylinder 212. The rotary-screen brackets 203 are provided to a sub-frame 204 to which the drive motor 209 is fixed and which is swingably supported on the machine frames 101, 101 of the impression cylinder 100. Moreover, the rotary-screen brackets 203 are supported on the sub-frame 204 in such a way as to be slidable in the axial direction of the rotary screen 201, and support the axially opposite ends of the rotary screen 201 in a rotatable manner. The rotary shafts 205, 206 are rotatably supported on the rotary-screen brackets 203. The rotary-screen position adjustment motor 211 and the tension cylinder 212 are arranged inside the sub-frame 204.

To describe this structure more specifically with reference to FIG. 2, the sub-frame 204 is formed in a box shape, and its longitudinal direction extends in the axial direction of the rotary screen 201. This sub-frame 204 is disposed in the vicinity of the rotary screen 201 and the impression cylinder 100.

Figure 3:
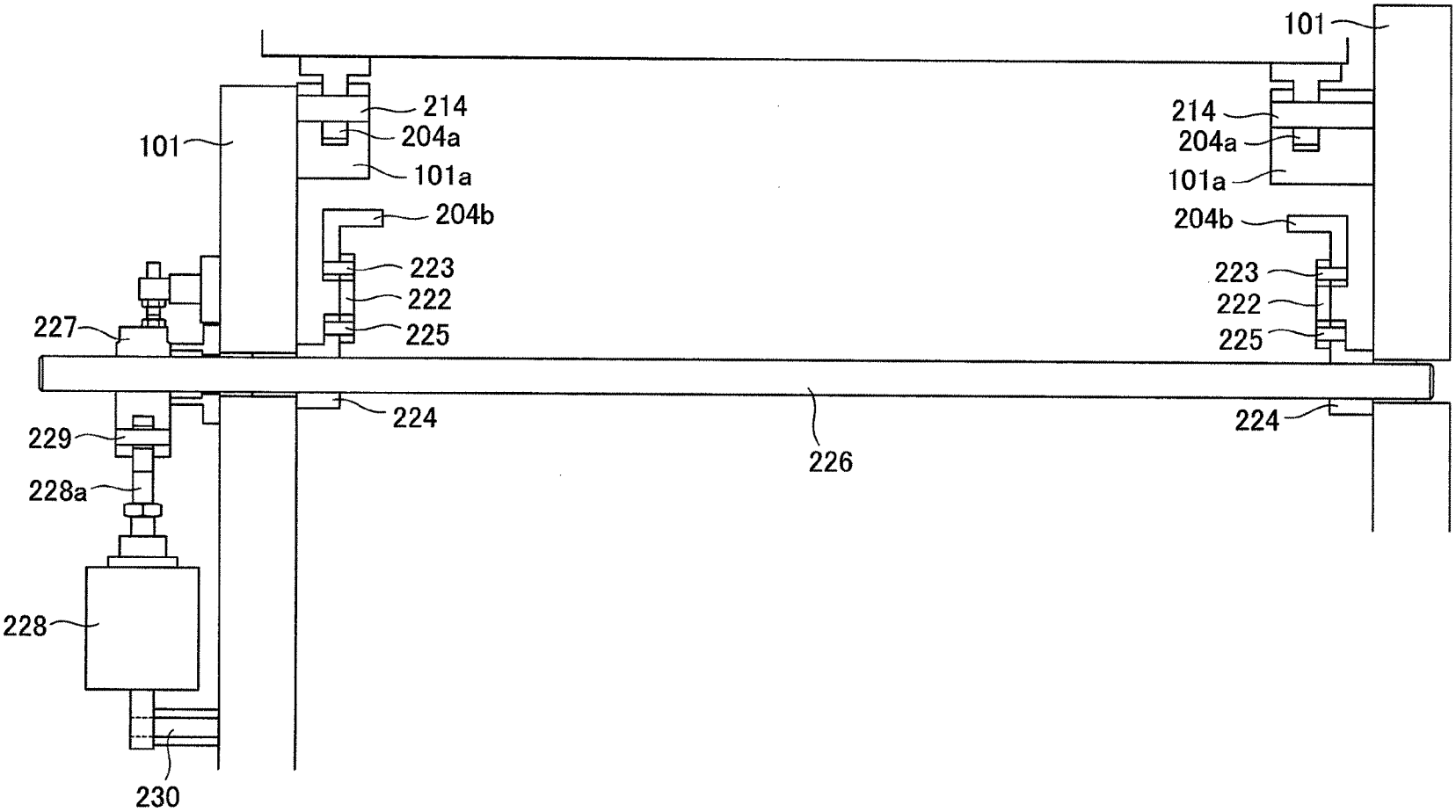
FIG. 3 is an explanatory view showing the relationship between frames and a sub-frame in the rotary screen printing press according to the embodiment of the present invention.

Note that as shown in FIG. 3, first coupling brackets 204*a* are formed at base end portions of the sub-frame 204 on the axially opposite sides thereof, and the first coupling brackets 204*a* are coupled to coupling brackets 101*a* provided to the machine frames 101 supporting the impression cylinder 100, the first coupling brackets 204*a* being swingably coupled to the coupling brackets 101*a* with pins 214 interposed therebetween.

Moreover, as shown in FIG. 2, a tip portion of each rotary-screen bracket 203 forms a rotary-screen supporting portion 203*a*, while a base end portion forms a rotary-shaft supporting portion 203*b*. The rotary-screen supporting portion 203*a* has a through-hole, and the bearing member 202 described above is rotatably supported in this through-hole. On the other hand, the rotary-shaft supporting portion 203*b* is formed in a frame shape, and a through-hole is formed in a surface thereof expanding perpendicularly to the axial direction. Moreover, the rotary shafts 205, 206 extending in parallel with the axial direction are rotatably supported in the through-holes in the rotary-shaft supporting portions 203*b* of the rotary-screen brackets 203 on both sides in the axial direction, respectively. Further, each rotary-shaft supporting portion 203*b* is slidably supported on a rail not shown extending in the axial direction of the rotary screen 201 inside the sub-frame 204.

Here, the rotary shaft 205 and the rotary shaft 206 are coupled to each other by a tubular coupling member 207 in such a way as to capable of rotating together and moving relative to each other in the axial direction. Specifically, one end of the rotary shaft 205 is inserted in and fixed to one end side of the coupling member 207. On the other hand, splines are formed on the inner peripheral surface of the other end side of the coupling member 207 and on the outer peripheral surface of one end side of the rotary shaft 206. The one end side of the rotary shaft 206 is inserted in the other end side of the coupling member 207 such that the splines formed on the coupling member 207 and the splines formed on the one end side of the rotary shaft 206 mesh with each other.

Moreover, the gear 205*a* is formed on the other end of the rotary shaft 205, and the gear 202*a* is formed on the outer peripheral surface of one of the bearing members 202 (the right one in FIG. 2). Moreover, the gear 205*a* of the rotary shaft 205 and the gear 202*a* of the one bearing member 202 are in mesh with each other with the intermediate gear 208 interposed therebetween, and the gear 205*a* of the rotary shaft 205 and the gear 209*a* of the drive motor 209 are also in mesh with each other (see FIG. 1).

Further, the gear 206*a* is formed on the other end of the rotary shaft 206 with the clutch 210 interposed therebetween, and another gear 202*a* is formed on the outer peripheral surface of the other bearing member 202 (the left one in FIG. 2). Also, the gear 206*a* of the rotary shaft 206 and the gear 202*a* of the other bearing member 202 are in mesh with each other with another intermediate gear 208 interposed therebetween.

Furthermore, the rotary-shaft supporting portion 203*b* of one of the rotary-screen brackets 203 (the right one in FIG. 2) is configured to be movable in the axial direction with the assistance of the rotary-screen position adjustment motor 211. Specifically, a screw 211*b* is formed at the tip of a drive rod 211*a* configured to rotate with the drive of the rotary-screen position adjustment motor 211. On the other hand, a block 239 in which a female screw threadedly engageable with the screw 211*b* is formed is fixed to the one rotary-shaft supporting portion 203*b*, and the screw 211*b* is threadedly attached to this block 239. Thus, the one rotary-shaft supporting portion 203*b* (rotary-screen bracket 203) moves in the axial direction along the above-mentioned rail not shown extending inside the sub-frame 204 as the screw 211*b* rotates with the drive of the rotary-screen position adjustment motor 211. Note that the rotary-screen position adjustment motor 211 adjusts the left-right (axial) position of the screen plate 201A by being driven in response to operation of a screen-plate left-right position adjustment switch 308 (see FIG. 5). The screen-plate left-right position adjustment switch 308 may be of a type which includes a left button and a right button and adjusts the left-right (axial) position of the screen plate 201A according to operation of these buttons, a type which involves inputting a moving direction and a moving amount, or the like, for example.

In addition, the tip of the tension cylinder 212 is in contact with a surface of the rotary-shaft supporting portion 203*b* of the other rotary-screen bracket 203 (the left one in FIG. 2), the surface expanding perpendicularly to the axial direction. The tension cylinder 212 is provided to apply force to and tension the rotary screen 201 in such a way as to stretch the rotary screen 201 in the axial direction thereof, and configured to push the other rotary-screen bracket 203 in the opposite direction from the one rotary-screen bracket 203. Thus, the rotary screen 201 is constantly subjected to tension in the axial direction thereof.

<Rotary-Screen Engaging-Disengaging Means>

Next, the rotary-screen engaging-disengaging means in this embodiment will be described with reference to FIGS. 1 and 3.

As shown in FIG. 1, in this embodiment, the rotary-screen engaging-disengaging means includes the above-described sub-frame 204 and rotary-screen brackets 203, as well as a screen-plate engagement-disengagement cylinder 228 coupled to the sub-frame 204 with first, second, and third link members 222, 224, 227 interposed therebetween.

To describe this structure more specifically with reference to FIGS. 1 and 3, the first link members 222 are coupled to second coupling brackets 204*b* formed at the axially opposite ends of the sub-frame 204, the first link members 222 being swingably coupled to the second coupling brackets 204*b* with pins 223 interposed therebetween. The first link members 222 are swingably coupled also to free end portions of the second link members 224 with pins 225 interposed therebetween. Base end portions of the second link members 224 are fixed to a rotary shaft 226.

Here, the first link members 222 and the second link members 224 are arranged at the inner side of the left and right machine frames 101. The rotary shaft 226 is arranged with its axial direction in parallel with the axial direction of the rotary screen 201 and penetrates the machine frames 101 in such a way that at least one end thereof (the left end in FIG. 3) protrudes to the outer side of the corresponding machine frame 101.

Moreover, a base end portion of the third link member 227 is fixed to the one end of the rotary shaft 226 at the outer side of the machine frame 101. A free end portion of the third link member 227 is swingably coupled to a drive rod 228*a* of the screen-plate engagement-disengagement cylinder 228 with a pin 229 interposed therebetween. The body of the screen-plate engagement-disengagement cylinder 228 is swingably coupled to the machine frame 101 with a pin 230 interposed therebetween. Moreover, a stopper 237 configured to limit swinging movement of the sub-frame 204 toward the impression cylinder 101 is disposed on and faces a side surface of the third link member 227.

<Squeegee>

While the rotary screen 201 is as described above, the squeegee 213 includes a blade 213A and a squeegee bar 213B and is inserted in the rotary screen 201 as shown in FIGS. 1 and 2. The blade 213A is a member configured to supply ink on the inner side of the screen plate 201A toward the impression cylinder 100 through the fine holes in the screen plate 201A, i.e. a squeegee body. The squeegee bar 213B is a support supporting the blade 213A and has a rectangular portion having a rectangular cross-sectional shape. In the rotary screen printing press, the tip of the blade 213A slides on the inner peripheral surface of the screen plate 201A, so that the ink supplied into the screen plate 201A is transferred onto the printing surface of a printing object through the fine holes.

The rotary screen printing press in this embodiment with such a structure includes squeegee position adjusting means and squeegee replacement assisting means.

<Squeegee Position Adjusting Means>

The squeegee position adjusting means in this embodiment will be described with reference to FIGS. 1, 2, 4, and 6.

As shown in FIGS. 1 and 2, in this embodiment, the squeegee position adjusting means includes, at each side in the axial direction: a squeegee engagement-disengagement cylinder 215 swingably supported on the sub-frame 204; a supporting plate 217 as an arm swingably supported on the sub-frame 204 and the squeegee engagement-disengagement cylinder 215; a squeegee supporting member 219 turnably supported on the supporting plate 217; an eccentric sleeve 221 as a squeegee position adjustment unit also turnably supported on the supporting plate 217; and a squeegee angle adjustment motor 238 fixed to the supporting plate 217.

The squeegee engagement-disengagement cylinder 215 is a two-stage cylinder, and a base end portion thereof is swingably supported on a third coupling bracket 204*c* formed at each axial end of the sub-frame 204. More specifically, the third coupling bracket 204*c* has a pin 216 fixed thereto, and the base end portion of the squeegee engagement-disengagement cylinder 215 is swingably supported on this pin 216.

The supporting plate 217 is a plate-shaped body, and a region thereof is notched in an arc shape, so that an arc-shaped notched portion is formed in the region. The squeegee supporting member 219 is turnably supported on this arc-shaped notched portion. Moreover, the above-mentioned squeegee engagement-disengagement cylinder 215 is swingably coupled to another region of the supporting plate 217 with a pin 218 interposed therebetween. Furthermore, the eccentric sleeve 221 is turnably supported on another region of the supporting plate 217, and a contact surface 217*a* which comes into contact with a screw 236 is formed in this another region as well. The screw 236 serves as a stopper (contact member) configured to limit turning movement of the supporting plate 217 toward the impression cylinder 100.

The squeegee supporting member 219 is a member configured to detachably hold the squeegee bar 213B, and includes a squeegee supporting portion 219A formed in a substantially semi-circular shape having a curved portion and a flat portion, a locking plate 219B disposed in such a way as to face the flat portion of the squeegee supporting portion 219A, and a handle 219C fixed to one end of the locking plate 219B.

A worm wheel 235 (see FIG. 4) is provided on the curved portion of the squeegee supporting portion 219A, and a worm 234 configured to mesh with this worm wheel 235 is supported on the supporting plate 217. The squeegee angle adjustment motor 238 is coupled to this worm 234. As the squeegee angle adjustment motor 238 is driven, the worm 234 is rotated, and the squeegee supporting member 219 is thereby turned via the worm gear along the arc-shaped notched portion about a center P2 of turning movement.

The squeegee angle adjustment motor 238 adjusts the angle at which the squeegee 213 contacts the screen plate 201A (hereinbelow, referred to as "squeegee angle") during printing via a squeegee angle adjustment switch 311 (see FIG. 5). Moreover, to detach the squeegee 213 for replacement or the like, the squeegee angle adjustment motor 238 is automatically driven along with the squeegee engagement-disengagement cylinder 215 to position the squeegee supporting member 219 at a preset angle suitable for replacement of the squeegee 213 (replacement angle).

Here, the squeegee angle adjustment switch 311 may be of a type which includes a plus button and a minus button and works according to operation of these buttons, a type which involves inputting a numeral value as an angle, or the like, for example. Moreover, while the example in which the squeegee angle adjustment motor 238 is used to rotate the worm 234 is described in this embodiment, the worm 234 may be rotated manually to turn the squeegee supporting member 219 through the worm gear along the arc-shaped notched portion about the center $P_2$ of turning movement.

Figure 4:
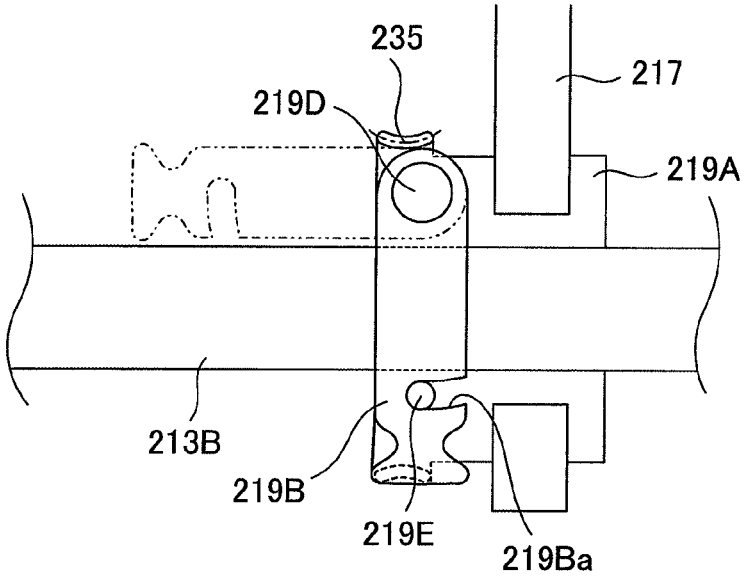
FIG. 4 is an explanatory view showing a squeegee supporting member of the rotary screen printing press according to the embodiment of the present invention.

A rectangular groove having a rectangular cross-sectional shape (rectangular recessed portion) which can be fitted to the squeegee bar 213B is formed in the center of the flat portion of the squeegee supporting portion 219A. Moreover, as shown in FIG. 4, abase end portion of the locking plate 219B is turnably supported on a pin 219D fixed to the squeegee supporting portion 219A. Thus, the locking plate 219B can be positioned at a fixing position at which the locking plate 219B covers an opening portion of the rectangular groove as illustrated in FIG. 4 with a solid line, and an opening position at which the rectangular groove is opened as illustrated in FIG. 4 with a two-dot chain line. Further, a pin 219E, to one end of which the handle 219C is fixed and on the other end of which a screw is formed, is threadedly engaged with the squeegee supporting portion 219A, and a notch 219Ba engageable with the pin 219E is formed in a free end portion of the locking plate 219B. According to this structure, by turning the handle 219C, the screw of the pin 219E operates in such a way that the locking plate 219B can be sandwiched and fixed between the flat portion of the squeegee supporting portion 219A and the lower end surface of the handle 219C or released from this sandwiched state.

Note that in this embodiment, the arrangement of the supporting plate 217 and the angle of the squeegee supporting member 219 are determined such that, as shown in FIG. 1, a center $P_1$ of the rotary screen 201, the center $P_2$ of turning movement of the squeegee 213 (squeegee supporting member 219), and a point $P_3$ of contact between the tip of the blade 213A and the screen plate 201A are all located along a straight line ($L_1$ shown in FIG. 1) during printing.

The eccentric sleeve 221 is swingably supported on a pin 220 fixed to a fourth coupling bracket 204*d* formed at each axial end of the sub-frame 204 and turnably supported on the supporting plate 217. Moreover, a slotted hole 221*a* is formed in a flange portion of the eccentric sleeve 221, and a pin 221*b* fixed to the supporting plate 217 is fitted in this slotted hole 221*a*.

This eccentric sleeve 221 is given an eccentric design so that, during printing, the tip of the blade 213A can be moved via the supporting plate 217 along a tangent line $L_2$ of the impression cylinder 100 at the above-mentioned contact point $P_3$, in other words, the position of the supporting plate 217 can be adjusted relative to a center $P_4$ of turning movement of the eccentric sleeve 221 in parallel with the tangent line $L_2$. Thus, as the eccentric sleeve 221 is turned, the eccentricity effect of the eccentric sleeve 221 moves the supporting plate 217 in parallel with the tangent line $L_2$, which in turn moves the tip of the blade 213A supported on the supporting plate 217 along the tangent line $L_2$.

Here, in this embodiment, the axis of the pin 220, i.e. the center $P_4$ of turning movement of the eccentric sleeve 221, is arranged on the tangent line $L_2$, and the above-mentioned contact surface 217*a* of the supporting plate 217 which comes into contact with the screw 236 is arranged at a position at which the contact surface 217*a* is flush with the tangent line $L_2$. However, the contact surface 217*a* does not necessarily have to be provided at this position at which it is flush with the tangent line $L_2$. The contact surface 217*a* only needs to be a surface which comes into contact with the screw 236 and is parallel with the tangent line $L_2$.

The above-mentioned screw 236 is threadedly engaged with a fifth coupling bracket 204*e* fixed to the sub-frame 204. The tip of the screw 236 protrudes from the fifth coupling bracket 204*e* toward the contact surface 217*a*. The pressing force of the blade 213A against the impression cylinder 100 during printing is adjusted based on the amount of protrusion of the screw 236. Here, the operator may directly turn the screw 236 to adjust the amount of protrusion of the screw 236, or a gear of a motor not shown may be engaged with the screw 236 and the screw 236 may be turned via a remote operation to adjust the amount of protrusion thereof.

In the rotary screen printing press according to this embodiment, the supporting plate 217, the squeegee supporting member 219, the eccentric sleeve 221, and the screw 236 form squeegee supporting means, and the worm 234 and the worm wheel 235 form an angle adjustment unit. Moreover, the screw 236 and the contact surface 217*a* form a stopper part.

<Squeegee Replacement Assisting Means>

Next, the squeegee replacement assisting means according to this embodiment will be described with reference to FIGS. 1, 2, and 6.

As shown in FIGS. 1 and 2, the squeegee replacement assisting means according to this embodiment includes a slide rail 231 and a hoist 232 turnably supported on this slide rail 231 with a hinge 233 interposed therebetween.

The slide rail 231 extends in the axial direction of the rotary screen 201 and is supported on the left and right machine frames 101 above the rotary screen 201. This slide rail 231 includes a fixed rail 231A, an intermediate rail 231B, and a movable rail 231C.

The fixed rail 231A is fixed to the left and right machine frames 101. The intermediate rail 231B is supported on the fixed rail 231A in such a way as to be slidable in the axial direction of the rotary screen 201. The movable rail 231C is supported on the intermediate rail 2312 in such a way as to be slidable in the axial direction of the rotary screen 201. In other words, the intermediate rail 231B is slidably coupled to both the fixed rail 231A and the movable rail 231C, so that the slide rail 231 functions as an extendable guide capable of extension and retraction. Moreover, the length to which this slide rail 231 extended by moving the intermediate rail 231B and the movable rail 231C is set to be greater than the axial length of the squeegee bar 213B. Note that this slide rail 231 is a guide rail having a similar structure to that of the slide rail disclosed in Patent Literature 2, for example, and configured to extend and retract in the longitudinal direction. Thus, detailed description thereof is omitted here.

Further, a base end portion of the hoist 232 is supported on one end (the left end in FIG. 2) of the movable rail 231C with the hinge 233 interposed therebetween such that the hoist 232 can be turned along the side surface of the corresponding frame 101. Moreover, this hoist 232 is provided at a free end portion thereof with a squeegee bearing portion 232A, a locking plate 232B, a handle 232C, squeegee raising-lowering means not shown, and a grip 232D.

Figure 6:
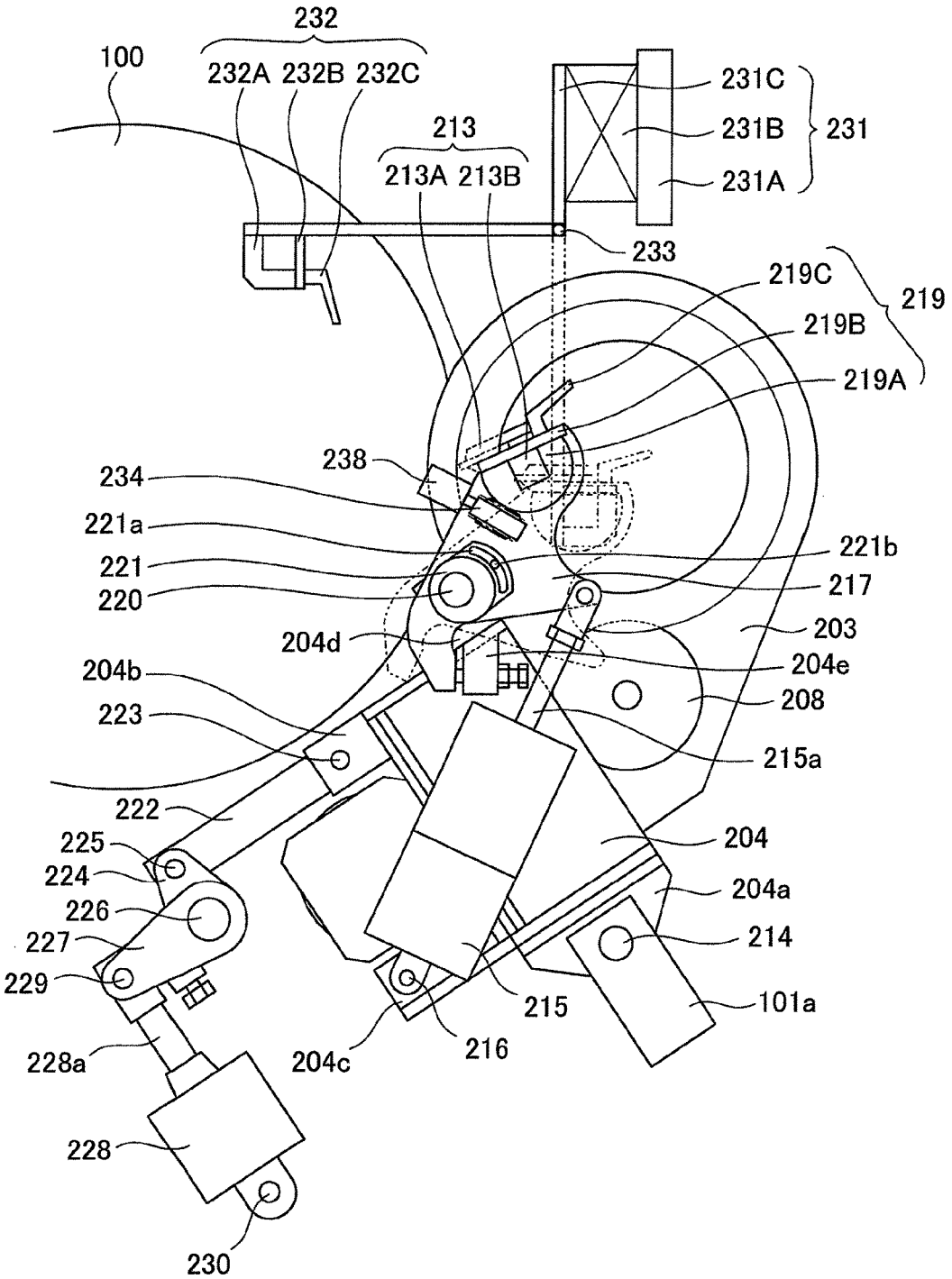
FIG. 6 is an explanatory view describing movement of a squeegee and movement of a hoist in the rotary screen printing press according to the embodiment of the present invention.

The squeegee bearing portion 232A is formed in an L-shape so that the squeegee bearing portion 232A at a hoist work position illustrated in FIG. 6 with two-dot chain lines can be fitted to a side surface and the lower surface of the squeegee bar 213B which has a rectangular shape in cross section.

The locking plate 232B is configured to fix the squeegee bar 213B housed in the squeegee bearing portion 232A by closing an opening portion of the squeegee bearing portion 232A. Note that the locking plate 232B is coupled to the squeegee bearing portion 232A with a screw not shown, and the locking plate 232B can be turned when the fastening of the squeegee bearing portion 232A and the locking plate 232B is loosened by turning the handle 232C fixed to the tip of the screw. Thus, the squeegee bar 213B can be detached from the squeegee bearing portion 232A or the squeegee bar 213B can be attached to the squeegee bearing portion 232A by turning the locking plate 232B to open the opening portion.

The squeegee raising-lowering means is means for moving the squeegee bearing portion 232A and the locking plate 232B together in the longitudinal direction of the hoist 232. For example, the squeegee raising-lowering means vertically moves the squeegee bar 213B supported on the squeegee bearing portion 232A with the bottom surface of the rectangular portion thereof held substantially horizontally. The squeegee raising-lowering means may be one supporting the squeegee bearing portion 232A on the hoist 232 with a feed screw interposed therebetween, and using a manually turned handle or a motor to rotate this feed screw. Alternatively, the squeegee raising-lowering means may be an air cylinder coupling the squeegee bearing portion 232A and the hoist 232. Note that the grip 232D is used to move the hoist 232, for example.

<Control Unit>

Next, control by the rotary screen printing press according to this embodiment will be described with reference to FIG. 5.

Figure 5:
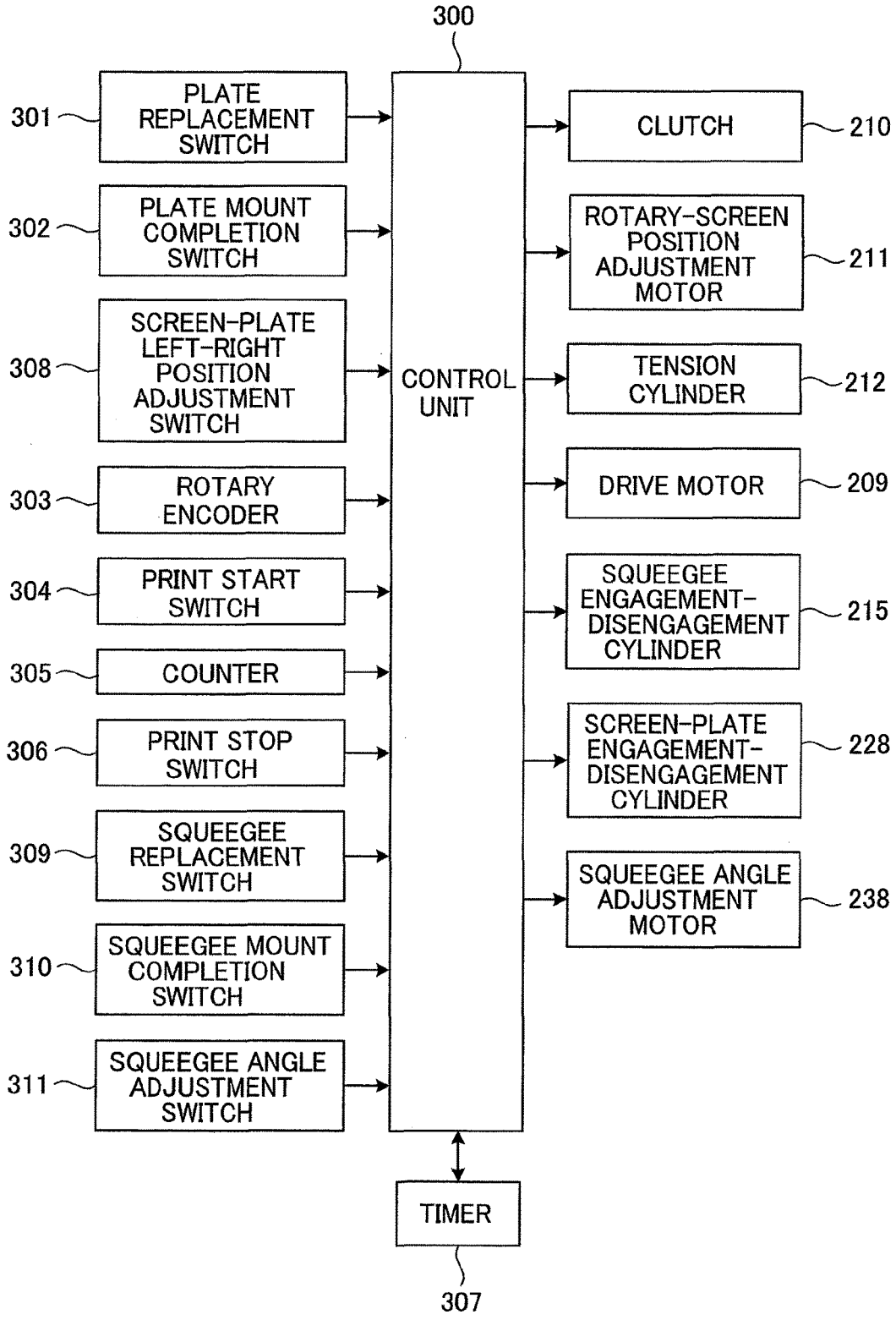
FIG. 5 is a block diagram showing the configuration of the rotary screen printing press according to the embodiment of the present invention.

As shown in FIG. 5, a control unit 300 of the rotary screen printing press according to this embodiment receives operation signals from a plate replacement switch 301, a plate mount completion switch 302, the screen-plate left-right position adjustment switch 308, a rotary encoder 303, a print start switch 304, a counter 305, and a print stop switch 306, a squeegee replacement switch 309, a squeegee mount completion switch 310, and a squeegee angle adjustment switch 311, and also receives a detection signal from a timer 307.

Moreover, the control unit 300 is configured to control drive of the clutch 210, the rotary-screen position adjustment motor 211, the tension cylinder 212, the drive motor 209, the squeegee engagement-disengagement cylinder 215, the screen-plate engagement-disengagement cylinder 228, the squeegee angle adjustment motor 238, and the timer 307.

<Printing>

First, the flow of control by the control unit 300 during printing will be described. In a case of performing printing, the control unit 300 receives an operation signal from the print start switch 304, and the rotary encoder 303 detects a print start phase for the first sheet (printing object). In response, the control unit 300 outputs a command to the squeegee engagement-disengagement cylinders 215 to extend their drive rods 215*a*, and also outputs a command to the screen-plate engagement-disengagement cylinder 228 to retract its drive rod 228*a*. As a result, the whole sub-frame 204 is swung via the third link member 227, the second link members 224, and the first link members 222 about the pins 214 in such a direction (counterclockwise in FIG. 1) as to approach the impression cylinder 100. Also, the supporting plates 217 are swung about the pins 220 in such a direction (counterclockwise in FIG. 1) that the blade 213A approaches the inner peripheral surface of the screen plate 201A. Accordingly, via the rotary-screen brackets 203 and the supporting plates 217, the rotary screen 201 is positioned from a rotary-screen disengagement position at which the screen plate 201A is separated from the impression cylinder 100, to a rotary-screen engagement position (the position illustrated in FIG. 1) at which the screen plate 201A is in contact with the impression cylinder 100. Also, inside the rotary screen 201, the squeegee 213 is positioned from a squeegee disengagement position at which the tip of the blade 213A is near the inner peripheral surface of the screen plate 201A but separated from the inner peripheral surface, to a squeegee engagement position (the position illustrated in FIG. 6 with solid lines) at which the tip of the blade 213A is in contact with the inner peripheral surface of the screen plate 201A. Note that the squeegee 213 is positioned by the squeegee supporting members 219 at an initial angle (the angle of the squeegee supporting members 219 at the squeegee engagement position—a preset angle with which a new squeegee 213 can be set at an optimal squeegee angle). In this step, the contact surfaces 217*a* of the supporting plates 217 come into contact with the tips of the screws 236 and pushed by the biasing force of the squeegee engagement-disengagement cylinders 215.

Here, for adjustment of the squeegee angle, it is done by operating the squeegee angle adjustment switch 311 to thereby drive each squeegee angle adjustment motor 238 via a remote operation and turn each squeegee supporting member 219 along the corresponding arc-shaped notched portion. Moreover, the displacement of the tip of the blade 213A in the direction of the tangent line $L_2$ caused by this step is corrected by turning each eccentric sleeve 221 to move the tip of the blade 213A in the direction of the tangent line $L_2$ and slide each contact surface 217*a*, which is in parallel with the tangent line $L_2$ (or, in this embodiment, formed at such a position as to be flush with the tangent line $L_2$), in the direction of the tangent line $L_2$ while maintaining the contact with the corresponding screw 236. Meanwhile, as described above, the pressing force of the blade 213A against the screen plate 201A is adjusted by adjusting the amount of protrusion of each screw 236.

Moreover, for registration of the screen plate 201A in the left-right direction (axial direction), the operator operates the screen-plate left-right position adjustment switch 308. When the screen-plate left-right position adjustment switch 308 is operated, the control unit 300 outputs a command to the rotary-screen position adjustment motor 211 to rotate its drive rod 211*a* in according with the request from the screen-plate left-right position adjustment switch 308. Here, in a case where the one rotary-screen bracket 203 is moved in a direction away from the other rotary-screen bracket 203, the rotary screen 201 is moved together in the axial direction, and the other rotary-screen bracket 203 is moved in the axial direction against the biasing force of the tension cylinder 212 to follow the movement of the one rotary-screen bracket 203 via the rotary screen 201. On the other hand, in a case where the rotary-screen position adjustment motor 211 is driven in the opposite direction from that in the above case, the one rotary-screen bracket 203 is moved in a direction toward the other rotary-screen bracket 203. By this movement of the one rotary-screen bracket 203, the rotary screen 201 is moved together in the axial direction, and the other rotary-screen bracket 203 is moved in the axial direction by the biasing force of the tension cylinder 212 to follow the movement of the one rotary-screen bracket 203. As a result, the rotary screen 201 is put in register in the left-right direction. Note that the left-right registration can be performed while printing is performed and after printing is finished.

Thereafter, when the print stop switch 306 is operated or the number of fed sheets counted by the counter 305 reaches a predetermined number, and the rotary encoder 303 detects a last-sheet print completion phase, the control unit 300 outputs a command to the squeegee engagement-disengagement cylinders 215 to retract their drive rods 215*a*, and also outputs a command to the screen-plate engagement-disengagement cylinder 228 to extend its drive rod 228*a*. As a result, the supporting plates 217 are swung about the pins 220 in such a direction (clockwise in FIG. 1) that the blade 213A moves away from the inner peripheral surface of the screen plate 201A, thereby moving the blade 213A from the squeegee engagement position to the squeegee disengagement position. Also, the whole sub-frame 204 is swung via the third link member 227, the second link members 224, and the first link members 222 about the pins 214 in such a direction (clockwise in FIG. 1) as to move away from the impression cylinder 100, thereby positioning the rotary screen 201 from the rotary-screen engagement position to the rotary-screen disengagement position via the rotary-screen brackets 203 and the supporting plates 217. The rotary screen printing press is now in a print finished state.

<Replacement of Screen Plate>

Thereafter, for plate replacement, first, the operator operates the squeegee replacement switch 309 in the above-mentioned print finished state (a state in which the rotary screen unit 200 is positioned at the rotary-screen disengagement position and the squeegee disengagement position). In response, the control unit 300 outputs a command to the squeegee engagement-disengagement cylinders 215 to retract their drive rods 215*a*, and also outputs a command to the squeegee angle adjustment motors 238 to set their squeegee supporting members 219 at the replacement angle. As a result, the supporting plates 217 are swung about the pins 220 in such a direction (clockwise in FIG. 1) that the blade 213A moves away from the inner peripheral surface of the screen plate 201A, and also the squeegee supporting members 219 are turned along the arc-shaped notched portions of the supporting plates 217. Accordingly, inside the rotary screen 201, the squeegee 213 is positioned from the squeegee disengagement position to a squeegee replacement position (position illustrated in FIG. 6 with two-dot chain lines) to which the squeegee 213 is retreated toward the axis of the rotary screen 201, and also the squeegee 213 is positioned by the squeegee supporting members 219 from the initial angle to the replacement angle.

Thereafter, the handles 219C of the squeegee supporting members 219 are turned to loosen the screws of the pins 219E and thereby release the locking plates 219B from the state of being sandwiched between the flat portions of the squeegee supporting portions 219A and the lower end surfaces of the handles 219C. Moreover, the locking plates 219B are turned to open the upper openings of the rectangular grooves in the left and right squeegee supporting members 219. Then, the hoist 232 is positioned from a hoist retreat position (a position at which the hoist 232 is disposed in such a way as not to overlap the opening portion of the rotary screen 201 in the radial direction; e.g. a position illustrated in FIG. 6 with solid lines), to the above-mentioned hoist work position (more specifically, a hoist nearby position at which the slide rail 231 is retracted and the hoist 232 is set near the frame 101 in the axial direction, and at which the hoist 232 is disposed with its squeegee bearing portion 232A substantially overlapping, in the radial direction, the squeegee supporting members 219 positioned at the squeegee replacement position). In this step, the squeegee bearing portion 232A is positioned lower than the squeegee 213 supported on the squeegee holding members 219 (squeegee mount position). Then, the squeegee bearing portion 232A is, for example, raised vertically with the squeegee raising-lowering means from the squeegee mount position (the state in which the squeegee bearing portion 232A is positioned lower than the squeegee 213 supported on the squeegee supporting members 219) to a squeegee dismount position (a state in which the squeegee bearing portion 232A is positioned higher than the squeegee 213 supported on the squeegee supporting members 219). When the squeegee bar 213B is fitted into the squeegee bearing portion 232A, the raising of the squeegee bearing portion 232A (squeegee 213) with the squeegee raising-lowering means is temporarily stopped. Then, the locking plate 232B is turned to close the opening portion, and the handle 232C is turned to fix the squeegee bar 213B to the squeegee bearing portion 232A in a sandwiching manner. Thereafter, the raising of the squeegee bearing portion 232A with the squeegee raising-lowering means is resumed. As a result, the squeegee bar 213B is detached from the rectangular grooves in the squeegee holding members 219. By the above steps, the squeegee bar 213B is transferred from the left and right squeegee supporting members 219 onto the squeegee bearing portion 232A.

Then, after the squeegee bar 213B is raised with the squeegee raising-lowering means to a position separated from the squeegee holding members 219, the raising of the squeegee 213 is stopped, and the hoist 232 is moved from the hoist nearby position to a hoist separated position (a position at which the hoist 232 is separated from the frame 101 in the axial direction of the rotary screen 201 as a result of extending the slide rail 231). When the hoist 232 is moved toward the hoist separated position, the slide rail 231 extends to guide the hoist 232.

Thereafter, when the plate replacement switch 301 is operated, the control unit 300 outputs a command to the clutch 210 to release its connection to the rotary shaft 226, and also outputs a command to the tension cylinder 212 to retract its drive rod. As a result, the connection between the clutch 210 and the rotary shaft 206 is released, and the pressing force of the tension cylinder 212 against the corresponding rotary-screen bracket 203 is released.

When the pressing force of the tension cylinder 212 against the rotary-screen bracket 203 is released in response to the command from the control unit 300, the operator releases the engagement of the work-side (left in FIG. 2) bearing member 202 and end ring 201B and also the engagement of the drive-side (right in FIG. 2) bearing member 202 and end ring 201B to remove the used plate. Note that the method of detaching the end rings 201 (rotary screen 201) from the bearing members 202 is as described above, and detailed description thereof is omitted here.

Thereafter, the end rings 201B are attached to the opposite ends of a new screen plate 201A. Then, the drive-side end ring 201B on the new screen plate 201A is attached to the drive-side bearing member 202. Thereafter, the work-side bearing member 202 is moved axially inward, the new screen plate 201A is turned for phase alignment with the work-side end ring 201B on the new screen plate 201A, and the end ring 201B is attached to the bearing member 202. The method of attaching the end rings 201 (rotary screen 201) to the bearing members 202 is as described above, and detailed description thereof is omitted here.

After the end rings 201B are attached to the bearing members 202, the hoist 232 is moved to the hoist nearby position. When the hoist 232 is moved to the hoist nearby position, the slide rail 231 retracts to guide the hoist 232.

After the hoist 232 is positioned to the hoist nearby position, the squeegee 213 is lowered with the squeegee raising-lowering means. When the squeegee bar 213B is fitted into the rectangular grooves in the left and right squeegee supporting members 219, the lowering of the squeegee 213 with the squeegee raising-lowering means is temporarily stopped. The handle 232C of the hoist 232 is then operated to release the squeegee bar 213 from the state of being sandwiched by the locking plate 232B, and the opening portion of the squeegee bearing portion 232A is opened. Thereafter, the lowering of the squeegee 213 with the squeegee raising-lowering means is resumed. As a result, the squeegee bearing portion 232A is lowered, and the squeegee bar 213B is detached from the squeegee bearing portion 232A. By the above steps, the squeegee bar 213B is transferred from the squeegee bearing portion 232A onto the left and right squeegee supporting members 219. Thereafter, the locking plates 219B of the left and right squeegee supporting members 219 are turned to such a position that the bottom surfaces of the notches 219Ba of the locking plates 219B come into contact with the pins 219E. Thus, the opening portions of the rectangular grooves are closed by the locking plates 219B. The handles 219C are then turned to fix the squeegee bar 213B inside the rectangular grooves in the left and right squeegee supporting members 219.

After the squeegee bar 213B is fixed to the squeegee supporting members 219, the hoist 232 is positioned to the hoist retreat position. Thereafter, when the squeegee mount completion switch 310 is operated, the control unit 300 outputs a command to the squeegee engagement-disengagement cylinders 215 to extend their drive rods 215*a*, and also outputs a command to the squeegee angle adjustment motors 238 to set their squeegee supporting members 219 at the initial angle. As a result, the supporting plates 217 are swung about the pins 220 in such a direction (counterclockwise in FIG. 1) that the blade 213A approaches the inner peripheral surface of the screen plate 201A, and also the squeegee supporting members 219 are turned along the arc-shaped notched portions of the supporting plates 217. Accordingly, inside the rotary screen 201, the squeegee 213 is positioned at the squeegee disengagement position, and also the squeegee 213 is positioned at the initial angle by the squeegee supporting members 219.

Then, the operator turns on the plate mount completion switch 302. When the plate mount completion switch 302 is operated, the control unit 300 outputs a command to the tension cylinder 212 to extend its drive rod 212*a*, and also outputs a command to the drive motor 209 to turn on and a command to the timer 307 to start timing. As a result, the rotary screen 201 is set to a tensioned state, and the drive of the drive motor 209 is transmitted to one end of the rotary screen 201 through the gear 209*a* of the drive motor 209, the gear 205*a* of the rotary shaft 205, one of the intermediate gears 208, the gear 202*a* of the one bearing members 202, and the one bearing member 202. Further, as the rotary screen 201 is rotated, the gear 206*a* of the rotary shaft 206 is rotated via the other bearing member 202 provided at the other end of the rotary screen 201, the gear 202*a* of the other bearing member 202, and the other intermediate gear 208. On the other hand, as the rotary shaft 205 is rotated, the rotary shaft 206 is rotated as well. Here, since the connection of the clutch 210 to the rotary shaft 206 has been released, the gear 206*a* of the rotary shaft 206 can be rotated freely relative to the rotary shaft 206.

Thereafter, after the timer 307 measures a first set period of time which is set in advance, the control unit 300 outputs a command to the clutch 210 to connect to the rotary shaft 206. As a result, the gear 206*a* is drivably connected so that the gear 206*a* can rotate together with the rotary shaft 206. Accordingly, the drive of the drive motor 209 is transmitted also to the other end of the rotary screen 201 through the gear 209*a* of the drive motor 209, the gear 205*a* of the rotary shaft 205, the rotary shaft 205, the coupling member 207, the rotary shaft 206, the clutch 210, the gear 206*a* of the rotary shaft 206, the other intermediate gear 208, the gear 202*a* of the other bearing member 202, and the other bearing member 202. The opposite ends of the rotary screen 201 are now rotationally driven by the drive motor 209.

Then, after the timer 307 measures a second set period of time, the control unit 300 outputs a command to the drive motor 209 to stop. By this step, the replacement of the screen plate 201A is completed.

<Replacement of Squeegee>

For replacement of the squeegee 213, the operator operates the squeegee replacement switch 309. In response, the control unit 300 outputs a command to the squeegee engagement-disengagement cylinders 215 to retract their drive rods 215*a*, and also outputs a command to the squeegee angle adjustment motors 238 to set their squeegee supporting members 219 at the replacement angle. As a result, the supporting plates 217 are swung about the pins 220 in such a direction (clockwise in FIG. 1) that the blade 213A moves away from the inner peripheral surface of the screen plate 201A, and also the squeegee supporting members 219 are turned along the arc-shaped notched portions of the supporting plates 217. Accordingly, inside the rotary screen 201, the squeegee 213 is positioned from the squeegee disengagement position to the squeegee replacement position to which the squeegee 213 is retreated toward the axis of the rotary screen 201, and also the squeegee 213 is positioned at the replacement angle by the squeegee supporting members 219.

Thereafter, the handles 219C of the squeegee supporting members 219 are turned to loosen the screws of the pins 219E and thereby release the locking plates 219B from the state of being sandwiched between the flat portions of the squeegee supporting portions 219A and the lower end surfaces of the handles 219C. Moreover, the locking plates 219B are turned to open the upper openings of the rectangular grooves in the left and right squeegee supporting members 219. Then, the hoist 232 is positioned from the hoist retreat position to the hoist work position. In this step, the squeegee bearing portion 232A is positioned lower than the squeegee 213 supported on the squeegee holding members 219 (mount position). Then, the squeegee bearing portion 232A is, for example, raised vertically with the squeegee raising-lowering means from the squeegee mount position to the squeegee dismount position. When the squeegee bar 213B is fitted into the squeegee bearing portion 232A, the raising of the squeegee bearing portion 232A (squeegee 213) with the squeegee raising-lowering means is temporarily stopped. Then, the locking plate 232B is turned to close the opening portion, and the handle 232C is turned to fix the squeegee bar 213B to the squeegee bearing portion 232A in the sandwiching manner. Thereafter, the raising of the squeegee bearing portion 232A with the squeegee raising-lowering means is resumed. As a result, the squeegee bar 213B is detached from the rectangular grooves in the squeegee holding members 219. By the above steps, the squeegee bar 213B is transferred from the left and right squeegee supporting members 219 onto the squeegee bearing portion 232A.

Then, after the squeegee bar 213B is raised with the squeegee raising-lowering means to a position separated from the squeegee holding members 219, the raising of the squeegee 213 is stopped, and the hoist 232 is moved from the hoist nearby position to the hoist separated position. When the hoist 232 is moved toward the hoist separated position, the slide rail 231 extends to guide the hoist 232.

Thereafter, the handle 232C of the hoist 232 is turned. As a result, the screw of the pin not shown operates in such a way as to release the squeegee bar 213B from the state of being sandwiched between the locking plate 232B and a flat portion of the squeegee bearing portion 232A. Then, the locking plate 232B is turned to open the upper opening of the rectangular groove in the squeegee bearing portion 232A, and the used squeegee 213 is removed.

Thereafter, for attachment of a new squeegee 213, the squeegee bar 213B of the new squeegee 213 is fitted into the rectangular groove in the squeegee bearing portion 232A, and the locking plate 232B is turned to close the opening portion. The handle 232C is then turned. As a result, the screw of the pin not shown operates in such a way as to sandwich and fix the squeegee bar 213B between the locking plate 232B and the flat portion of the squeegee bearing portion 232A, so that the squeegee 213 is supported at one end.

Thereafter, the squeegee 213 is raised with the squeegee raising-lowering means via the squeegee bearing portion 232A and the locking plate 232B, and the hoist 232 is moved to the hoist nearby position. When the hoist 232 is moved to the hoist nearby position, the slide rail 231 retracts to guide the hoist 232.

After the hoist 232 is positioned to the hoist nearby position, the squeegee 213 is lowered with the squeegee raising-lowering means. When the squeegee bar 213B is fitted into the rectangular grooves in the left and right squeegee supporting members 219, the lowering of the squeegee 213 with the squeegee raising-lowering means is temporarily stopped. The locking plate 232B is then operated to open the opening portion, and the lowering of the squeegee 213 with the squeegee raising-lowering means is resumed. As a result, the squeegee bearing portion 232A is lowered, and the squeegee bar 213B is detached from the squeegee bearing portion 232A. By the above steps, the squeegee bar 213B is transferred from the squeegee bearing portion 232A onto the left and right squeegee supporting members 219. Thereafter, the locking plates 219B of the left and right squeegee supporting members 219 are turned to such a position that the bottom surfaces of the notches 219Ba of the locking plates 219B come into contact with the pins 219E. Thus, the opening portions of the rectangular grooves are closed by the locking plates 219B. The handles 219C are then turned. As a result, the screws of the pins not shown operate in such a way as to fix the squeegee bar 213B inside the rectangular grooves in the left and right squeegee supporting members 219.

After the squeegee bar 213B is fixed to the squeegee supporting members 219, the hoist 232 is positioned to the hoist retreat position.

Thereafter, when the squeegee mount completion switch 310 is operated, the control unit 300 outputs a command to the squeegee engagement-disengagement cylinders 215 to extend their drive rods 215*a*, and also outputs a command to the squeegee angle adjustment motors 238 to set their squeegee supporting members 219 at the initial angle. As a result, the supporting plates 217 are swung about the pins 220 in such a direction (counterclockwise in FIG. 1) that the blade 213A approaches the inner peripheral surface of the screen plate 201A, and also the squeegee supporting members 219 are turned along the arc-shaped notched portions of the supporting plates 217. Accordingly, inside the rotary screen 201, the squeegee 213 is positioned from the squeegee replacement position to which the squeegee 213 has been retreated toward the axis of the rotary screen 201, to the squeegee disengagement position, and also the squeegee 213 is positioned at the initial angle by the squeegee supporting members 219. By this step, the replacement of the squeegee 213 is completed.

The rotary screen printing press according to this embodiment described above brings about the following advantageous effects.

First, the squeegee supporting members 219, the squeegee angle adjustment motors 238, and the eccentric sleeves 221 are supported on the supporting plates 217, and the eccentric sleeves 221 are given an eccentric design so that the tip of the blade 213A can be moved along the tangent line $L_2$ of the impression cylinder 100 at the point $P_3$ of contact between the tip of the blade 213A and the screen plate 201A. When the squeegee angle is adjusted by operating the squeegee angle adjustment switch 311 to turn the squeegee supporting members 219 with the squeegee angle adjustment motors 238, this angle adjustment displaces the tip of the blade 213A from the contact point $P_3$. However, the displacement can be corrected by turning the eccentric sleeves 221 to move the supporting plates 217 in parallel with the tangent line $L_2$.

Moreover, the contact surfaces 217*a* which come into contact with the screws 236 of the supporting plates 217 are arranged at such a position as to be parallel with (in this embodiment, to be flush with) the tangent line $L_2$. In this way, when the eccentric sleeves 221 move the blade 213A along the tangent line $L_2$, the contact surfaces 217*a* and the screws 236 can make the supporting plates 217 move in parallel with the tangent line $L_2$ in cooperation with the eccentric sleeves 221. In addition, since the contact surfaces 217*a* move in parallel with the tangent line $L_2$ when the eccentric sleeves 221 move the blade 213A, the pressing force of the blade 213A applied to the screen plate 201A in the state where the squeegee 213 is disposed at the squeegee engagement position can be maintained constant.

Moreover, in a case of adjusting the squeegee angle based on the type of ink or the like, the squeegee angle is adjusted by turning the squeegee supporting members 219 with the worms 234. Here, the rotary screen printing press according to this embodiment is configured such that the above-mentioned three points $P_1$, $P_2$, $P_3$ are all located along a straight line. Thus, when the squeegee supporting members 219 are turned for the angle adjustment of the blade 213A, the tip of the blade 213A is moved away from the inner peripheral surface of the screen plate 201A. In this way, it is possible to prevent a situation where the tip of the blade 213A is moved toward the screen plate 201A and excessively large pressing force is applied from the blade 213A onto the screen plate 201A. Accordingly, the screen plate 201A will never be damaged when the squeegee angle is adjusted.

Further, the squeegee angle adjustment motors 238 are provided so that the squeegee supporting portions 219A can be adjusted automatically to the replacement angle when the squeegee 213 is positioned to the hoist work position. In this way, the rectangular grooves in the squeegee supporting portions 219A are oriented always at the replacement angle suitable for replacement, when the squeegee bar 213B is transferred from the squeegee supporting portions 219A onto the squeegee bearing portion 232A or when the squeegee bar 213B is transferred from the squeegee bearing portion 232A onto the squeegee supporting portions 219A for replacement of the squeegee 213 or the like. Thus, the transferring work can be done smoothly. Accordingly, the burden on the operator is reduced.

Moreover, since the supporting plates 217 are supported on the sub-frame 204, the left and right (axial) positions at which the supporting plates 217 support the squeegee 213 can be closer to each other. In this way, it is possible to minimize the length of the squeegee 213 and therefore reduce the weight of the squeegee 213. Accordingly, the burden on the operator can be reduced significantly.

Moreover, the squeegee 213 and the rotary screen 201 can be moved at the same time to the rotary screen disengagement position, for example, when printing starts or when printing ends. Thus, the time taken to move the rotary screen 201 and the squeegee 213 can be shortened as compared to conventional cases. Accordingly, the efficiency during printing can be improved. Specifically, in conventional rotary screen units, means for engaging and disengaging the rotary screen 201 to and from the impression cylinder 100 and means for engaging and disengaging the squeegee 213 to and from the rotary screen 201 are configured to be driven independently of each other. For example, when printing ends, it is necessary to firstly move the squeegee 213 toward the axis of the rotary screen 201 to protect the screen plate 201A from the blade 201A, and then separate the rotary screen 201 from the impression cylinder 100, and therefore the rotary screen 201 is not separated immediately. Moreover, since the rotary screen 201 needs to be separated from the impression cylinder 100 immediately after the end of printing, the squeegee 213 is moved toward the axis of the rotary screen 201 in the middle of the printing of the last sheet so that the rotary screen 201 can be separated from the impression cylinder 100 immediately after the end of printing. This causes defective printing of the last sheet. On the other hand, in the rotary screen printing press according to this embodiment, the supporting plates 217 are supported on the sub-frame 204, and therefore the squeegee 213 and the rotary screen 201 can be moved at the same time to the rotary screen disengagement position immediately after the last sheet is printed. Thus, the rotary screen printing press according to this embodiment has the advantage that printing can be performed without wasting the last sheet.

Moreover, the axially opposite ends of the rotary screen 201 are rotationally driven. Thus, unlike a case where one end of the rotary screen 201 is rotationally driven, it is possible to prevent a situation where the rotations of the rotary screen 201 on the left and right sides (the two axial sides) shift relative to each other when the blade 201A is pressed against the inner peripheral surface of the screen plate 201A during printing, thereby causing misregistration on the left and right sides. Accordingly, the print quality can be improved.

Moreover, in conventional structures in which the opposite ends of the rotary screen are rotationally driven, the positions of the bearing members 202 relative to the rotary-screen brackets 203 in the circumferential direction are fixed. Thus, if the reference positions of the end rings 201B in the circumferential direction are offset from each other when they are attached to the screen plate 201A, the screen plate 201A will be twisted across the left and right sides (the two sides in the axial direction) when the left and right end rings 201B are attached to their bearing members 202. If the reference positions of the end rings 201B and the screen plate 201A in the circumferential direction are somewhat offset from each other when they are attached to each other, the screen plate 201A will be twisted across the left and right sides (the two axial sides) when the left and right end rings 201B are attached to their bearing members 202. This can possibly result in misregistration on the left and right sides. On the other hand, in the rotary screen printing press according to this embodiment, the rotary-screen rotationally driving means includes the clutch 210. Thus, when the rotary screen 201 is to be rotationally driven, the opposite ends of the rotary screen 201 can be attached to the bearing members 202 firstly with the clutch 210 and the rotary shaft 206 disconnected from each other. In this way, even if the reference positions of the end rings 201B and the screen plate 201A in the circumferential direction are somewhat offset from each other when they are attached to each other, the screen plate 201A can be attached to the bearing members 202 without being twisted, thereby preventing misregistration on the drive side and the work side of the rotary screen 201. Accordingly, the print quality can be improved.

Furthermore, since the clutch 210 is connected after one side of the rotary screen 201 is driven for a given period of time by the drive motor 209, the states of the gears on the left and right sides (axially opposite sides) of the rotary screen 201 (the phases of the gear 202*a* of the one bearing member 202, the one intermediate gear 208, and the gear 205*a* of the rotary shaft 205, and the phases of the gear 202*a* of the other bearing member 202, the other intermediate gear 208, and the gear 206*a* of the rotary shaft 206) coincide with each other. Accordingly, misregistration on the left and right sides due to backlash can also be prevented.

In addition, in this embodiment, it is possible to select between a state where the gear 206*a* of the rotary shaft 206 and the rotary shaft 206 can rotate freely relative to each other and a state where they can rotate together.

Moreover, the hoist 232 is provided which is supported and moved by the slide rail 231 between the hoist nearby position near the frame 101 and the hoist separated position separated from the frame 101. Also, the axis of swinging movement of the hoist 232 is in parallel with the axial direction of the rotary screen 201. In this way, the hoist 232 can be swung along the side surface of the frame 101, and does not greatly protrude from the side surface of the frame 101 even when positioned at the hoist retreat position. Thus, the hoist 232 does not obstruct the operator. Moreover, the hoist 232 does not obstruct visual check on the state of the ink on the rotary screen 201 through the opening at the end of the rotary screen 201 or access to the inside of the rotary screen 201. Accordingly, check, adjustment, and maintenance work can be performed easily.

Moreover, during the movement of the hoist 232 to the hoist nearby position or the hoist separated position, the squeegee 213 is passed through the inside of the rotary screen 201. Here, since the openings of the end rings 201B of the rotary screen 201 have a large diameter, the squeegee 213 does not contact the end rings 201B. Moreover, since raised by the squeegee raising-lowering means, the squeegee 213 does not contact any of the squeegee supporting members 219 (worm wheels 235) positioned at the replacement position. Accordingly, the squeegee 213, the end rings 201B, and the squeegee supporting members 219 do not get damaged.

Moreover, by using the slide rail 231 capable of supporting the hoist 232 at one end, neither the hoist 232 nor the slide rail 231 hardly protrudes to the outer side of the frame 101 when the hoist 232 is positioned at the hoist nearby position. Accordingly, the hoist 232 and the slide rail 231 do not obstruct work. Further, with the hoist 232 and the slide rail 231 having the above-described structure, replacement work of the squeegee can be done by a single operator.

Note that in the rotary screen printing press according to this embodiment described above, motors may be used instead of the cylinders, namely the squeegee engagement-disengagement cylinder 215 provided to move the squeegee 213 to the engagement and disengagement positions and the hoist retreat position, and the screen-plate engagement-disengagement cylinder 228 provided to move the rotary screen 201 and the squeegee 213 between the print position and the hoist retreat position.

INDUSTRIAL APPLICABILITY

The present invention is preferably applicable to a rotary screen printing press which performs screen printing by using a cylindrical screen plate.

REFERENCE SIGNS LIST

100 IMPRESSION CYLINDER
101 FRAME
200 ROTARY SCREEN UNIT
201 ROTARY SCREEN
201A SCREEN PLATE
201B END RING
202 BEARING MEMBER
202*a* GEAR OF BEARING MEMBER
203 ROTARY-SCREEN BRACKET
203*a* ROTARY-SCREEN SUPPORTING PORTION
203*b* ROTARY-SHAFT SUPPORTING PORTION
204 SUB-FRAME
204*a* FIRST COUPLING BRACKET
204*b* SECOND COUPLING BRACKET
204*c* THIRD COUPLING BRACKET
204*d* FOURTH COUPLING BRACKET
204*e* FIFTH COUPLING BRACKET
205, 206 ROTARY SHAFT
205*a*, 206*b* GEAR OF ROTARY SHAFT
207 COUPLING MEMBER
208 INTERMEDIATE GEAR
209 DRIVE MOTOR
209*a* GEAR OF DRIVE MOTOR
210 CLUTCH

211 ROTARY-SCREEN POSITION ADJUSTMENT MOTOR
211*a* DRIVE ROD OF ROTARY-SCREEN POSITION ADJUSTMENT MOTOR
211*b* SCREW
212 TENSION CYLINDER
213 SQUEEGEE
213A BLADE
213B SQUEEGEE BAR
214, 216, 218, 220, 223, 225, 229, 230 PIN
215 SQUEEGEE ENGAGEMENT-DISENGAGEMENT CYLINDER
215*a* DRIVE ROD OF SQUEEGEE ENGAGEMENT-DISENGAGEMENT CYLINDER
217 SUPPORTING PLATE
217*a* CONTACT SURFACE
219 SQUEEGEE SUPPORTING MEMBER
219A SQUEEGEE SUPPORTING PORTION
219B LOCKING PLATE
219Ba NOTCH
219C HANDLE
219D PIN
219E PIN
221 ECCENTRIC SLEEVE
221*a* SLOTTED HOLE
221*b* PIN
222 FIRST LINK MEMBER
224 SECOND LINK MEMBER
226 ROTARY SHAFT
227 THIRD LINK MEMBER
228 SCREEN-PLATE ENGAGEMENT-DISENGAGEMENT CYLINDER
228*a* DRIVE ROD OF SCREEN-PLATE ENGAGEMENT-DISENGAGEMENT CYLINDER
231 SLIDE RAIL
231*a* FIXED RAIL
231*b* INTERMEDIATE RAIL
231*c* MOVABLE RAIL
232 HOIST
232A SQUEEGEE BEARING PORTION
232B LOCKING PLATE
232C HANDLE
233 HINGE
234 WORM
235 WORM GEAR
236 SCREW
237 STOPPER
238 SQUEEGEE ANGLE ADJUSTMENT MOTOR
239 BLOCK
300 CONTROL UNIT
301 PLATE REPLACEMENT SWITCH
302 PLATE MOUNT COMPLETION SWITCH
303 ROTARY ENCODER
304 PRINT START SWITCH
305 COUNTER
306 PRINT STOP SWITCH
307 TIMER
308 SCREEN-PLATE LEFT-RIGHT POSITION ADJUSTMENT SWITCH
309 SQUEEGEE REPLACEMENT SWITCH
310 SQUEEGEE MOUNT COMPLETION SWITCH
311 SQUEEGEE ANGLE ADJUSTMENT SWITCH

The invention claimed is:

1. A rotary screen printing press, comprising:
a screen plate formed in a cylindrical shape;
a squeegee;
squeegee supporting means for supporting the squeegee; and
an angle adjustment unit configured to adjust an angle of the squeegee, wherein
the squeegee supporting means includes
an arm swingably supported and supporting the angle adjustment unit,
a squeegee position adjustment unit configured to adjust a position of a center of swinging movement of the arm, and
a stopper part configured to limit a direction of the movement of the arm, and
the squeegee position adjustment unit and the stopper part cooperate with each other to move a tip of the squeegee along a tangent line of an impression cylinder at a position at which the screen plate and the squeegee contact each other, and wherein
the stopper part includes a contact surface formed as a flat surface, and a contact member configured to contact the contact surface, and
the squeegee position adjustment unit and the stopper part cooperate with each other to adjust a position of the tip of the squeegee in parallel with the tangent line of the impression cylinder at a position at which the screen plate and the squeegee contact each other so as to correct a displacement of the tip of the squeegee in a direction of the tangent line caused by the adjustment of the angle of the squeegee.

2. The rotary screen printing press according to claim 1, wherein
the center of the swinging movement of the arm and the contact surface are arranged on the tangent line of the impression cylinder at the position at which the screen plate and the squeegee contact each other.

3. The rotary screen printing press according to claim 1, wherein
the contact member adjusts a pressing force of the squeegee against the impression cylinder.

* * * * *